United States Patent [19]

Charreron et al.

[11] Patent Number: 4,723,889

[45] Date of Patent: Feb. 9, 1988

[54] FAN OR COMPRESSOR ANGULAR CLEARANCE LIMITING DEVICE

[75] Inventors: Denis C. Charreron, Saint Mery; Patrick L. E. Girault, Boissise le Roi; Jean V. F. Reboul, Melun; Jacques M. P. Stenneler, Le Chatelet en Brie, all of France

[73] Assignee: Societe Nationale d'Etude et de Constructions de Moteur d'Aviation "S.N.E.C.M.A.", Paris, France

[21] Appl. No.: 882,401

[22] Filed: Jul. 7, 1986

[30] Foreign Application Priority Data

Jul. 16, 1985 [FR] France ..... 85 10857

[51] Int. Cl.[4] ..... F01D 5/10; F01D 5/32

[52] U.S. Cl. ..... 416/193 A; 416/220 R

[58] Field of Search ..... 416/193 A, 221, 220 R, 416/220 A, 193 A, 219 R

[56] References Cited

U.S. PATENT DOCUMENTS

| | | | |
|---|---|---|---|
| 2,937,849 | 5/1960 | Danforth . | |
| 2,948,505 | 8/1960 | Sonder . | |
| 3,037,741 | 6/1962 | Tuft . | |
| 3,047,268 | 7/1962 | Leavitt | 416/220 R |
| 3,119,595 | 1/1964 | Wilson . | |
| 3,393,862 | 7/1968 | Harrison | 416/220 R |
| 3,501,247 | 3/1970 | Tournere | 415/189 |
| 3,887,298 | 6/1975 | Hess et al. | 416/220 R |
| 4,101,245 | 7/1978 | Hess et al. | 416/190 |
| 4,182,598 | 1/1980 | Nelson | 416/193 A |
| 4,334,827 | 6/1982 | Bouiller et al. | 416/220 R |
| 4,405,285 | 9/1983 | Surdi | 416/220 R |
| 4,457,668 | 7/1984 | Hallinger | 416/193 A |
| 4,478,554 | 10/1984 | Surdi | 416/220 R X |
| 4,494,909 | 1/1985 | Forestier | 416/193 A X |
| 4,516,910 | 5/1985 | Bouiller et al. | 416/193 A X |
| 4,527,952 | 7/1985 | Forestier et al. | 416/220 R |
| 4,604,033 | 8/1986 | Surdi | 416/220 R |

FOREIGN PATENT DOCUMENTS

| | | | |
|---|---|---|---|
| 1112993 | 8/1961 | Fed. Rep. of Germany . | |
| 2542394 | 4/1976 | Fed. Rep. of Germany | 416/193 A |
| 2159857 | 7/1977 | Fed. Rep. of Germany | 416/193 A |
| 1222315 | 4/1959 | France . | |
| 2527260 | 5/1982 | France . | |
| 68614 | 6/1977 | Japan | 416/193 A |
| 670665 | 4/1952 | United Kingdom . | |
| 1259750 | 7/1970 | United Kingdom . | |
| 1457417 | 6/1973 | United Kingdom . | |
| 2038959 | 7/1980 | United Kingdom | 416/220 R |
| 2112466 | 12/1981 | United Kingdom . | |
| 836371 | 6/1981 | U.S.S.R. | 416/193 A |

*Primary Examiner*—Everette A. Powell, Jr.

*Attorney, Agent, or Firm*—Oblon, Fisher, Spivak, McClelland & Maier

[57] ABSTRACT

A turbomachine rotor disc assembly includes a rotor disc having a plurality of blade-root grooves in its periphery, each two adjacent grooves defining a lobe lug between them. Rotor blades each include an aerofoil portion, a root portion, a platform defining the radially inner boundary of the aerofoil portion, and a stilt portion interconnecting the radially inner face of the platform and the root portion, a free space being defined between each adjacent pair of blades. The angular clearance of each blade in its groove is limited by wedges operative between adjacent blades on the stilts thereof and connecting members carrying the wedges secured to the rotor disc and capable of transmitting shock loads and distributing resultant forces over an adjacent sector of the rotor. The wedges are so dimensioned in relation to the dimensions of the stilts of adjacent blades that the angular clearance is limited to the permissible angular clearance of each blade during auto-rotation of the rotor.

8 Claims, 10 Drawing Figures

FAN OR COMPRESSOR ANGULAR CLEARANCE LIMITING DEVICE

BACKGROUND OF THE INVENTION

1. Field of the Invention

The present invention relates to turbo-machines, more particularly means for securing and for limiting the angular clearance of the rotor blades of fans and compressors.

2. Description of the Prior Art

Turbo-machine rotor blades are secured in a known mannner on the periphery of a rotor disc and conventionally include, beneath a platform and separated therefrom by a stilt, a root of a fir-tree or dovetail form engaged in a correspondingly shaped groove of the rotor disc. For assembly reasons, when blades with fins or peripheral platforms are concerned, the designer is required to provide a substantial space between the blade root and the bottom of the groove. Such space is occupied by an axial wedge which provides correct location of the root of each blade in the corresponding grooves.

An assembly of this kind is illustrated for example in French patent specification No. 2 345 605 in the name of Societe Nationale D'Etude et de Construction de Moteurs.

Such blades are thus liable when at rest to have a relatively substantial angular clearance on one side and on the other of a radial plane including the major axis of the blade, such clearance being kept at a given value by the calculated spacing between the platforms of adjacent blades.

However, problems arise for fan or low pressure compressor blades of a turbo-machine, particularly an aircraft jet engine because the fan rotor or low pressure compressor rotor lies at the upstream end of the turbojet engine, and may be subjected to shocks in flight resultant from the ingestion of birds and under the tangential force of the shock of the blade, the latter being subjected to deflection and simultaneously subjected to rotation about its major axis because of the substantial degree of freedom in rotation permitted at the root of the blade as has been discussed hereinbefore.

If the mass of the ingested bird is substantial, the energy of the shock can be sufficient to lead to partial break up of one or more blades, or even their complete fracture, which may lead furthermore to destruction of downstream stages of the compressor or fan.

This disadvantage is further accentuated for fan blades having fins at mid-height of the blade, because under the effect of the tangential force resulting from the shock, the adjacent fins override one another, which will lead with near certainty in the destruction of the fan blades and as a result the partial or total destruction of the downstream stages of the compressor, which in turn may lead to the complete stopage of the turbojet engine and in the worst cases, particularly if the aircraft has only a single engine, leading to the loss of the aircraft.

An example of this kind of assembly is disclosed in French Pat. No. 2 286 282 which features rotor blades of which the platforms are engaged upon the edges of a cage, the latter being based upon two discs, one upstream, the other downstream interconnected by narrow rails or bars extending axially and disposed beneath the platforms in a space between two adjacent platforms which remains free between the stilts, the root of the blade being engaged in a groove of the rotor disc and the cage locked on the rotor disc.

Such device where the blade root is not wedged in its groove gives rise to the disadvantage of permitting substantial rotation of the blade in the groove of the disc and of leading to substantial vibration between the blades and the cage on which the platforms rest.

Attempts have therefore been made to suppress such vibrations especially by providing, beneath the platforms of the blades in the space remaining free between the stilts, wedges engaged beneath the platforms, either by centrifugal force during rotation of the rotor, or as is taught by British Pat. No. 670 665 or U.S. Pat. Nos. 4,182,598 or 4,101,245, or by a resilient means as disclosed in French Pat. No. 2 527 260 in the name of Societe Nationale D'Etude et de Construction de Moteurs.

However, even if such devices fulfil an anti-vibration function by limiting the radial displacement of the blades, in general they do not limit the angular twisting of the latter under the shock action. Furthermore such devices cannot absorb the energy of the shock on a blade in order to transmit it and to distribute it for example over a whole sector of the disc where the energy would be dissipated.

SUMMARY OF THE INVENTION

One of the object of the invention is thus to limit during operation the angular clearance of a rotor blade of a turbojet engine, particularly a fan blade or a low pressure compressor blade and more particularly a blade with lateral fins, in order to prevent the risk of overlapping of the fins under the action of an accidental shock.

A further object of the invention is to provide a device which will be capable of accommodating the energy of a shock applied to a blade, when a bird is accidentally ingested in flight for example and to deaden this impact by causing the force to be accommodated by the disc/drum connection through a specific flange of the disc or of the drum, in accordance with a modification of the invention or by two or three adjacent blades to that which has been subjected to the shock, in accordance with another modification.

An auxiliary object of the invention is to provide a device which, in addition to the advantage referred to above, will enable the deadening of vibrations to which blades are susceptible.

The invention also has as its object in a modification of one embodiment to provide simple means having the advantages referred to and capable of being adapted to existing rotor disc and only requiring detailed modifications of the rotor discs, which can readily be carried out in a maintenance workshop and which does not require long term and costly down time for service of the turbojet engine.

According to the present invention there is provided in a turbomachine rotor disc assembly means defining a rotor disc having a plurality of blade-root accommodating grooves in its outer periphery, each two adjacent grooves defining a lug between them, a corresponding plurality of rotor blades, each blade including an aerofoil portion, a root portion, a platform defining the radially inner boundary of the aerofoil portion, and a stilt portion interconnecting the radially inner face of the platform and the root portion, a free space being defined between each adjacent pair of blades, each blade root being engaged in a corresponding said groove of the rotor, and means for limiting the angular clearance of each blade permitting the blade to twist about its major axis, said limiting means comprising wedge means operative between adjacent blades on the stilts thereof and connecting means carrying the wedge means, secured to the rotor disc and capable of transmitting shock loads and distributing resultant forces over an adjacent sector of the rotor, the wedge means being so dimensioned in relation to the dimensions of stilts of adjacent blades that the angular clearance is limited to the permissible angular clearance of each blade during auto-rotation of the rotor.

In accordance with a further main characteristic of the invention, the intermediate connecting means is constituted by an annular member comprising a plane radial portion, the member being disposed downstream of the rotor disc and made rigid with the latter and the wedge means are constituted by projections of the radial portion of the member, said projections being rectangular in cross-section and disposed parallel to the axis of rotation of the rotor in the free spaces between each pair of adjacent stilts and made in monobloc manner with said radial plane portion of the annular member, the width of each of the projections being substantially equal to that of the free space between the stilts.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

FIG. *7a* is a view taken on line AA of FIG. 6, showing the vibration damping means and FIG. *7b* is a section taken an line BB of FIG. *7a.

DESCRIPTION OF THE PREFERRED EMBODIMENTS

Figure 1:
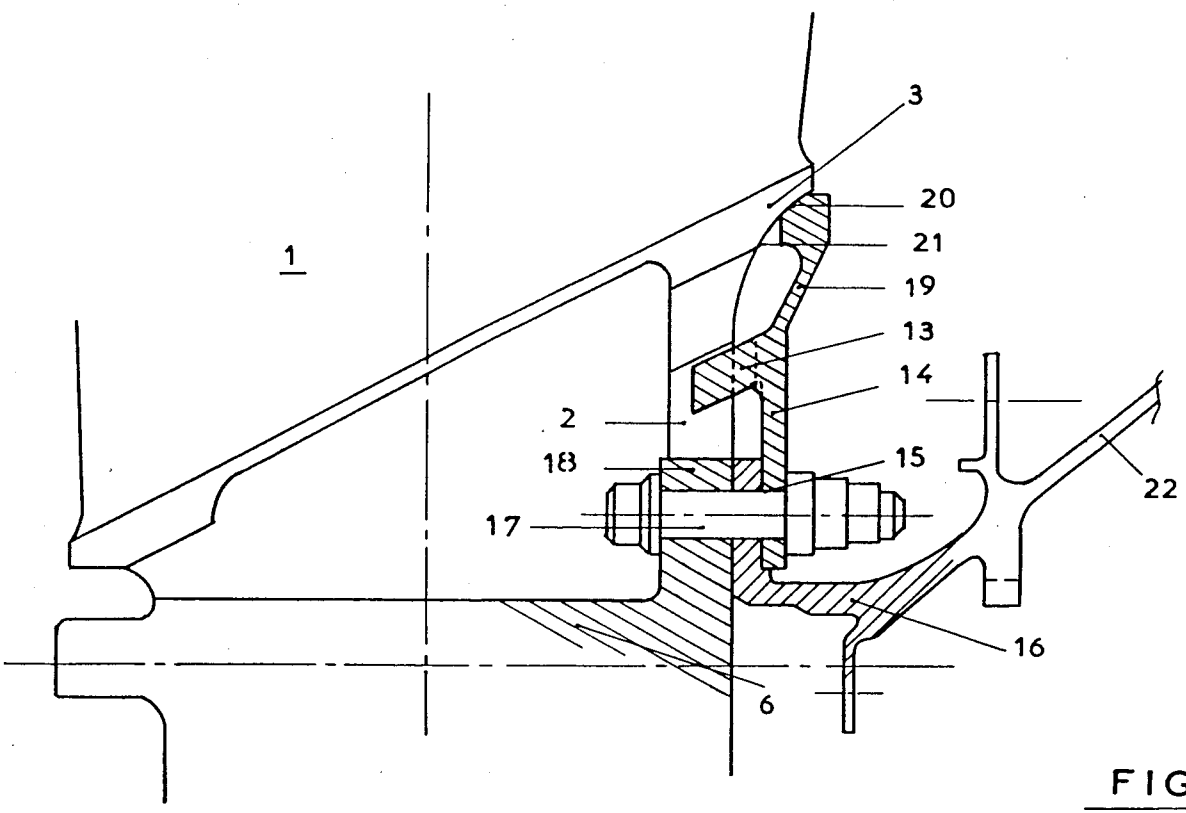
FIG. 1 is a view of an assembly of a fan blade on a rotor disc incorporating an angular clearance limitation device in accordance with a first embodiment in which the forces applied to a blade are accommodated by securing bolts operative between the rotor disc and a flange, the view being a radial section of the rotor disc passing through one of the lobes of the latter.
Figure 2:
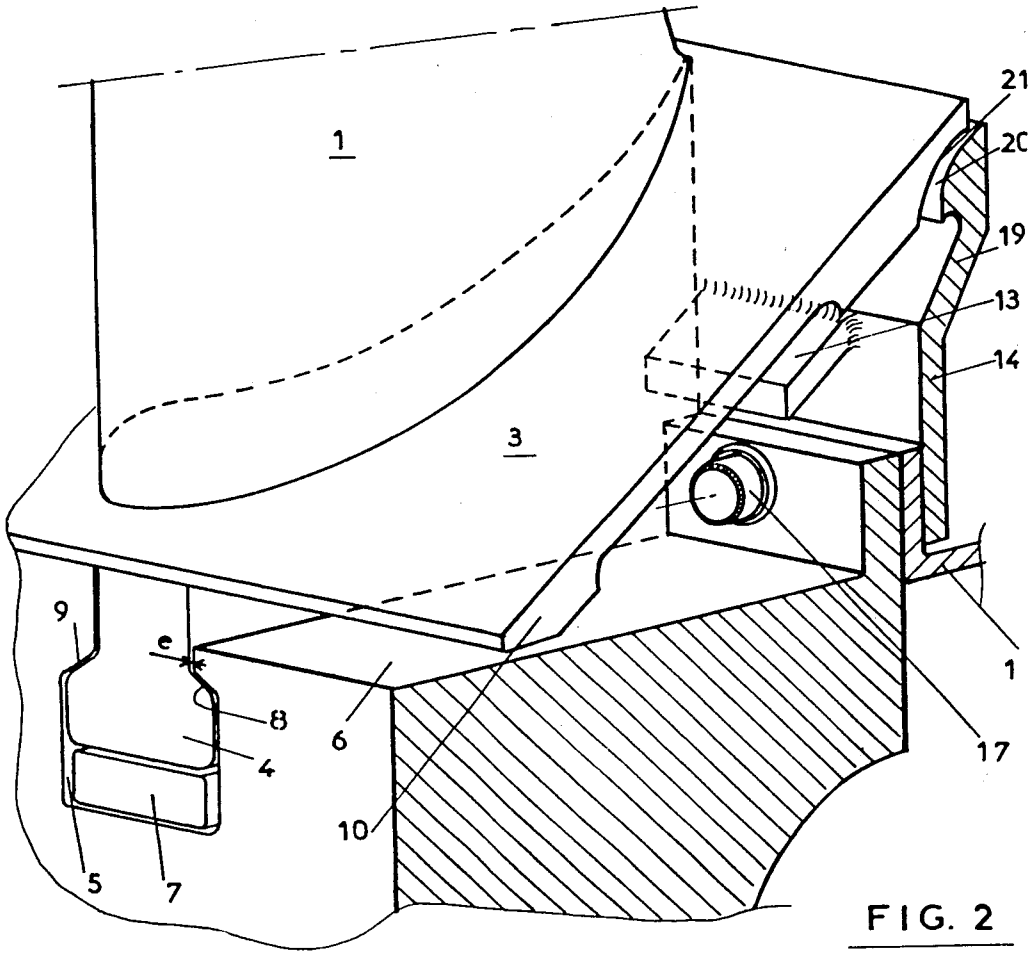
FIG. 2 is a perspective view, partly in section, of the assembly of FIG. 1 while FIG. *2a* illustrates a sector including two blades with fins and incorporating a device in accordance with the invention.
Figure 2A:
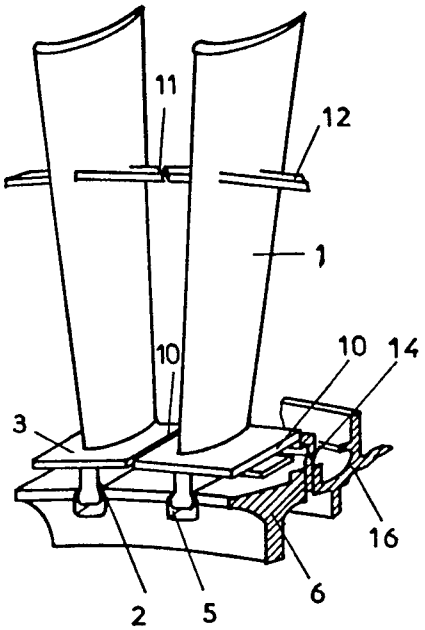

Referring to FIGS. 1 and 2, a fan blade 1 is shown diagrammatically and has a stilt 2 including a platform 3 of which the root 4 is mounted with clearance in known manner in a groove 5 of a rotor disc 6. The roots 4 of the blades 1, are in contact at their innermost faces with wedges 7 disposed at the base of the groove 5. The clearance between the inclined upper faces 8 of the root and the corresponding faces 9 of the groove 5 as well as the clearance "e" between the stilt and the upper part of the groove provide the blade 1 when auto-rotating, with an angular clearance or angular range of movement of about 4° about the diametral longitudinal plane of the rotor, containing the major axis of the blade. In operation, the blade root 4 has its faces 8 applied by centrifugal force against the faces 9 of the upper part of the groove 5. Because of this, the lateral faces 10 of the platforms 3 of adjacent blades as well as the lateral faces 11 of the fins 12 are substantially in contact with one another.

In order to avoid, when one of the blades 1 is subjected to accidental shock during operation, the latter being destabilized, between vibration and/or subjected to deflection under the effect of the tangential force resulting from the shock, the rotor disc is provided with the device in accordance with the invention for limiting angular clearance.

In the embodiment of FIGS. 1 and 2 the device comprises wedge means in the form of teeth 13 supported by intermediate connection means 14. The latter takes the form of a downstream annular member comprising a plane circular radial portion 14 in the inner peripheral part of which bores 15 are provided which enables downstream assembly on the rotor disc 6 and in a flanged member 16 which connects the fan stage to the first stage of the rotor of the low pressure compressor. The rotor disc 6, the flanged member 16 and the annular member 14 are interconnected by bolts 17 which pass through lugs 18 of the rotor disc, bores of the flanged member 16 and the bores 15 of the annular member constituting the intermediate connection means. The flanged member 16 forms a part of the rotor drum, only part of which is shown.

The teeth 13 serving as wedge means are made in the form of upstream projections from the radial plane portion of the annular member 14, these teeth having a cross-section which is substantially rectangular and being disposed parallel to the axis of rotation of the rotor or, if the platform 3 is substantially inclined in the upstream direction, as is illustrated in FIGS. 1 and 2, they lie parallel to the lower face of the platform. The teeth 13 located as high as possible on the stilt are engaged in the free space lying between the stilts, the clearance between the stilts and the teeth being calculated to be as small as possible in order to limit the angular clearance of the blade to the maximum value which can be tolerated during auto-rotation. The cross-section of the teeth 13, the thickness of the annular member 14 and the bore 15 formed without clearance with respect to the bolt 17 are so dimensioned as to impart to the annular member 14 a sufficiently stiff structure to transmit and to take up by the bolts acting as the connection between the disc and the flange, any force in which a blade is subjected during an accidental shock.

The annular member 14 also acts to dampen any vibrations which the blades may suffer. In order to effect this, the member 14 comprises on the periphery of its plane radial portion a frusto-conical extension 19 inclined in the downstream direction and including a seating in the form of an arcuate section face 20 at its periphery having a curvature in section corresponding to that of the downstream under face 21 of an edge portion of the platform 3. When the annular member 14 is mounted on the rotor disc 6 by the bolts 17, the arcuate section face 20 of the disc abuts and exerts a pressure on the under face 21 of all the platforms 3, under the action of centrifugal force and this ensures damping of any blade vibrations.

In addition, the device serving to limit the angular clearance of the blades provides a sealing function since it at least reduces gas flows between the stilts.

Dependent upon the geometry of the rotor disc and of the drum and according to whether the annular member is disposed between the rotor disc and the drum, or behind the flange of the drum, it will be formed by one or two semi-circular parts.

Figure 3:
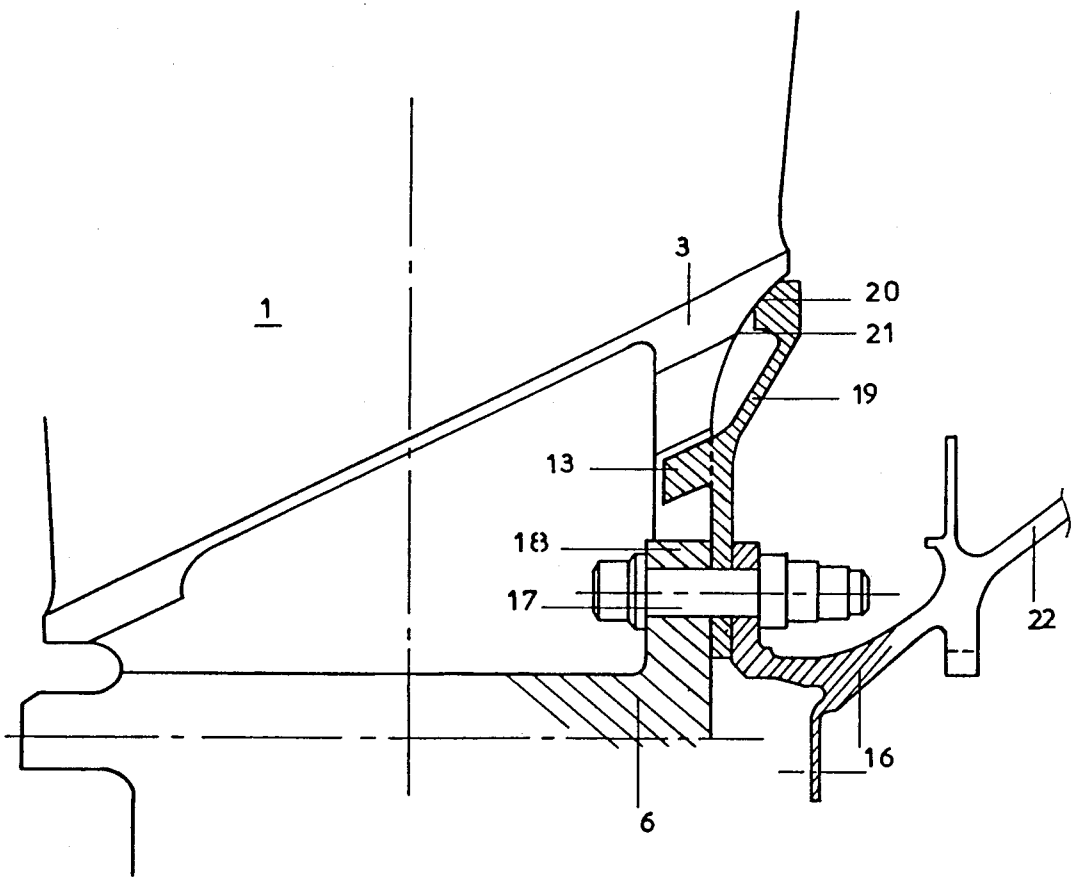
FIG. 3 illustrates, partly in section, a modification of the embodiment of FIGS. 1 and 2.

In the modification of FIG. 3 the annular member 14 is made as a single annular part and located between the rotor disc 6 and the flanged member 16. The overall structure (teeth 13 for angular wedging and damping by application against a seating 20 beneath the platform) is identical with the construction illustrated in FIG. 1. described.

Figure 4:
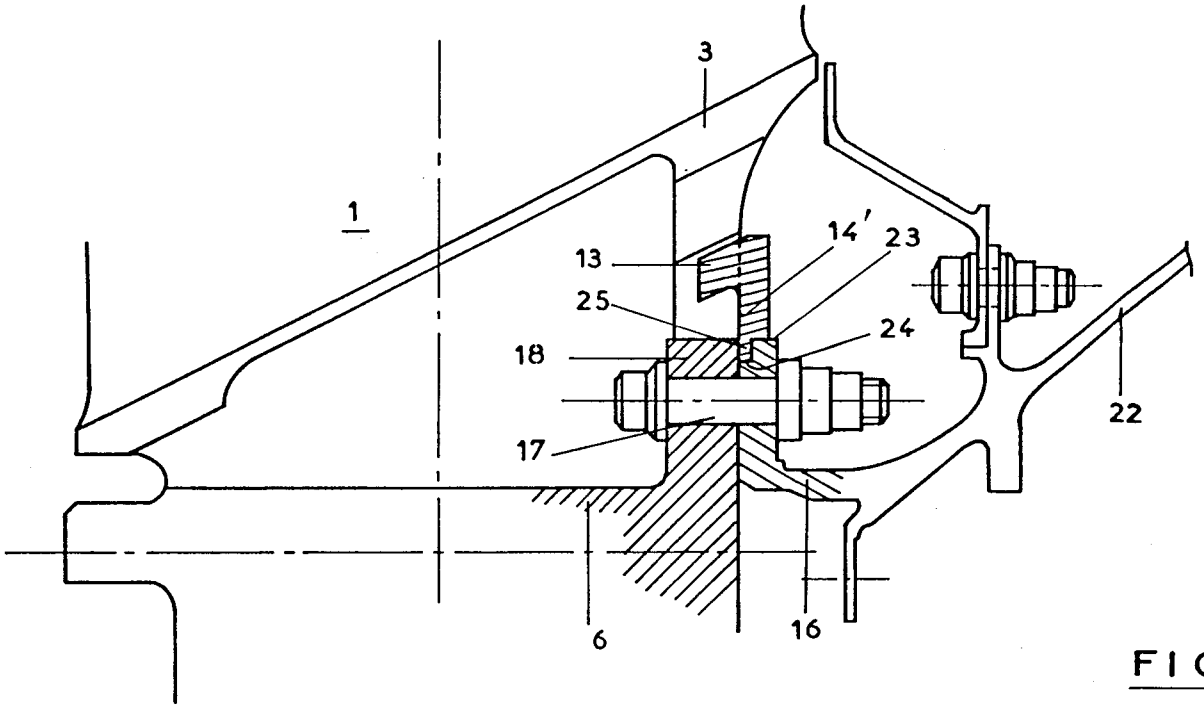
FIG. 4 illustrates, partly in section, a second modification in which the forces accommodated by a blade are transmitted through a ring which constitutes a part of the device for limiting the angular clearance of the blade with respect to two or three adjacent blades, and which enables the bolt connection to remain unloaded.

In FIG. 4, another embodiment has been illustrated of an annular downstream member comprising wedging means in accordance with the invention. In this embodiment the annular member 14' is not secured by locking bolts to the rotor disc 6. It is constituted by a simple plane annular bearing member 14' integral the teeth 13 and is centred on the outer annular face 23 of the flange 16. The face 23 is stepped to form an annular recess 24 which enables, by careful monitoring of the manufacturing tolerances, the annular member 14' to be locked axially, between the two flanges of the disc-drum connection.

Thus, in this embodiment, the accommodation of the force to which a blade is subjected which it suffers impact is taken up by adjacent blades, the annular member 14' being displaced when the blade receives the impact and comes into contact with an adjacent tooth 13.

Because of this arrangement, this embodiment enables damping of the force on two or three blades because the forces are integrally accommodated or absorbed by adjacent blades without overloading of the rotor disc or of the drum.

Figure 5:
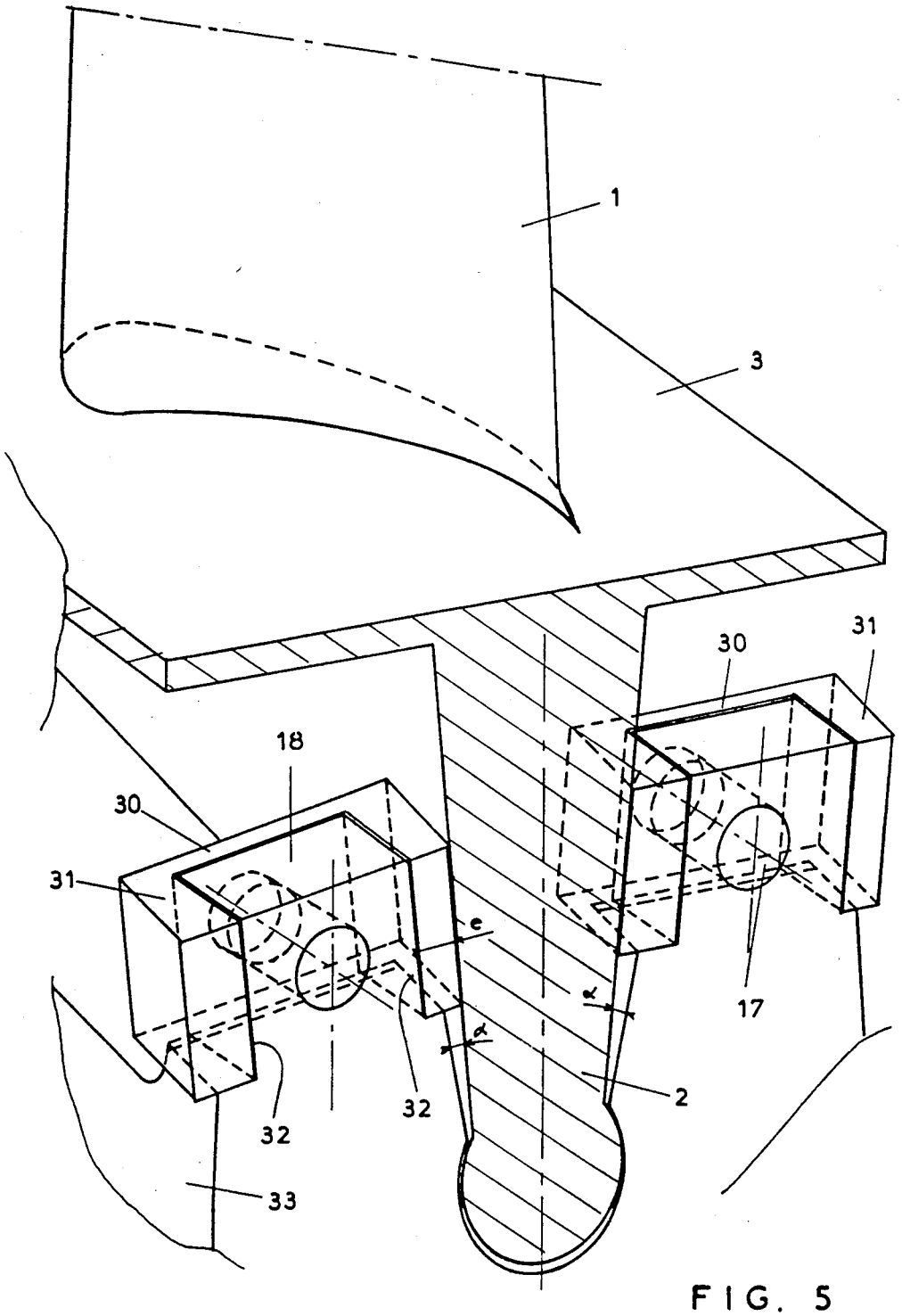
FIG. 5 illustrates in a rear perspective view, partly in section, a second embodiment of the invention in which the limitation in the angular displacement of a blade is effected by spacers carried on the lobes of the rotor disc.

In FIG. 5, the perspective diagram, partly in section, illustrates another embodiment of the invention viewed from downstream of the rotor disc. In this embodiment, the wedging means and the intermediate connection means are constituted by U-shaped spacers 30 mounted like a saddle on a radially outer part of each lug 18 of the rotor disc, the base of the U forming intermediate connection means and being secured to the lugs 18 by connecting bolts between the rotor disc 6 and the flanged member 16 (not illustrated in FIG. 5), whilst the limbs 31 of the U serve as wedge means in accordance with the invention.

It is already known to absorb the forces to which the blade is subjected directly by the lugs or lobes of the rotor disc, the latter being machined in such a way that the clearance between them and the stilts will be sufficiently small to limit the angular clearance of the blades. However, the precise machining of the bores is not readily effected when it is desired to ensure that this function will be satisfactorily carried out. Furthermore, when the device is put out of action by ingestion of a bird or other object, the risk is substantial that the lugs or lobes of the rotor disc will be deformed, which results in very costly repairs.

The spacers, such as are provided in accordance with the present invention enable resolution of these problems since their machining is far simpler than that of bores of the disc and because they enable a better limitation of the angular clearance because it is possible to position them high on the lugs or lobes of the rotor disc, this being the result of the dissociation of the function of limiting angular clearance with respect of the disc in comparison with the earlier solution of direct limitation of angular clearance by the lobes of the rotor disc itself.

The base portion 30 of each spacer is located at its inner surface on the upstream face of the lug or lobe 18 of which the lateral faces 32 are machined to match the internal dimension between the limbs of the spacer. It will be seen in FIG. 5 that the conventional inclination of the lateral faces 33 of the lugs would permit in the absence of the spacer an angular clearance $2\alpha$ in relation to the stilt 2 of the blade 1.

The careful selection of the thickness "e" of the limbs 31 of the spacer (FIG. 5) enables limitation of the angular clearance of the blade 1 to a value at most equal to its maximum value permitted during auto-rotation. Such wedging means has the advantage of being capable of being adapted readily to an existing rotor disc, by simple machining of the lateral faces of the lugs or lobes 32 of the rotor disc 6, which can be readily effected in a maintenance workshop without long term immobilization of the engine and without special and complex machine tools.

Figure 6:
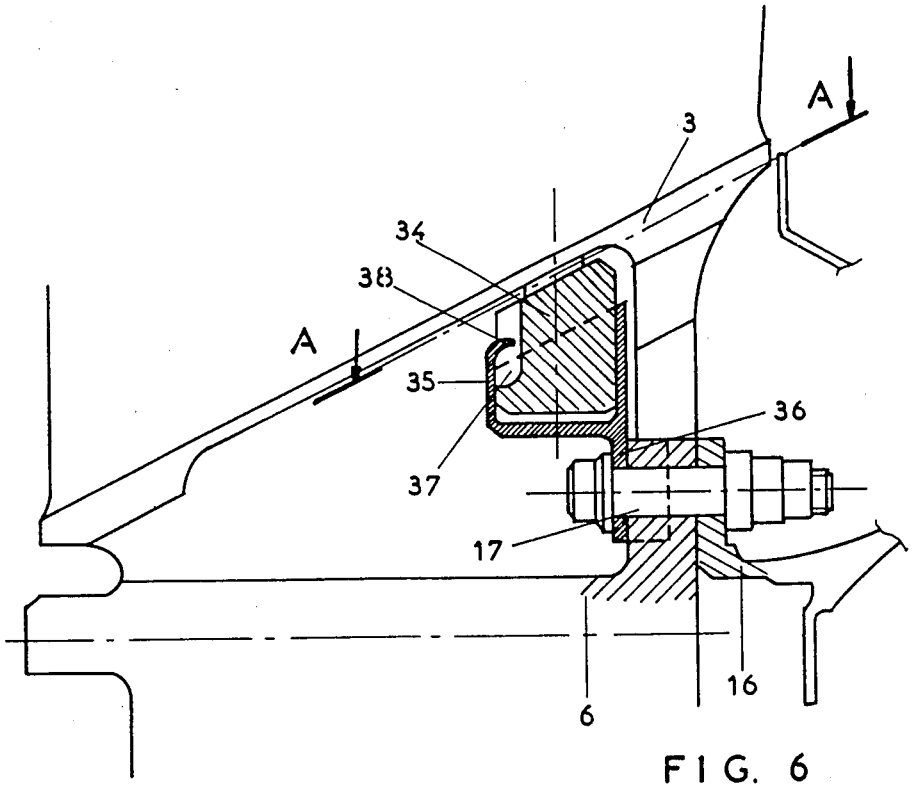
FIG. 6 illustrates, partly in section, in the zone of one of the rotor disc lobes, a modification of the second embodiment incorporating means for damping blade vibrations.
Figure 7B:
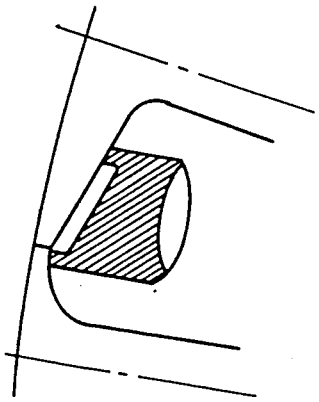
Figure 7A:
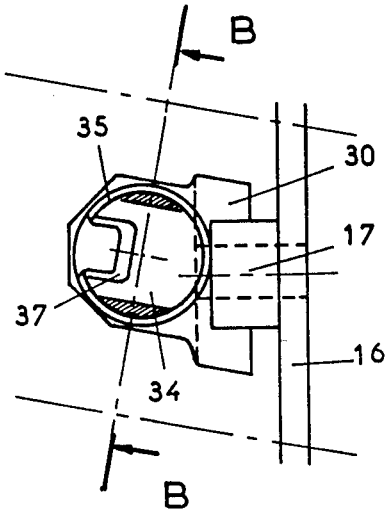

This embodiment of the angular clearance limitation means in accordance with the invention thus constitutes a simple improvement from the point of view of achieving practical application and of low cost for fan rotors or low pressure compressor rotors of existing turbomachines. Such spacers can be associated as is illustrated in FIGS. 6,*7a*,*7b*, with means for damping vibrations which the blades are liable to suffer, such means being constituted by a block 34 of a generally cylindrical form free to slide radially in a cylindrical sheath 35 having a radial orientation and carried by the spacer 30, or by means of a fixing member 36 connected to the spacer by the looking bolt 17 (FIG. 6), or by the sheath 35 and the spacer 30 being made in a single piece (FIG. *7a*). The block 34 comprises at its periphery a longitudinal groove 37 cooperating with a tongue 38 of the sheath or other securing member 35 so as to enable the block to have only a single degree of freedom in radial sliding motion so that the block will be applied beneath the platform 3 by centrifugal force during rotation of the rotor and thus exerts on the platform a force which counteracts vibration.

Figure 8:
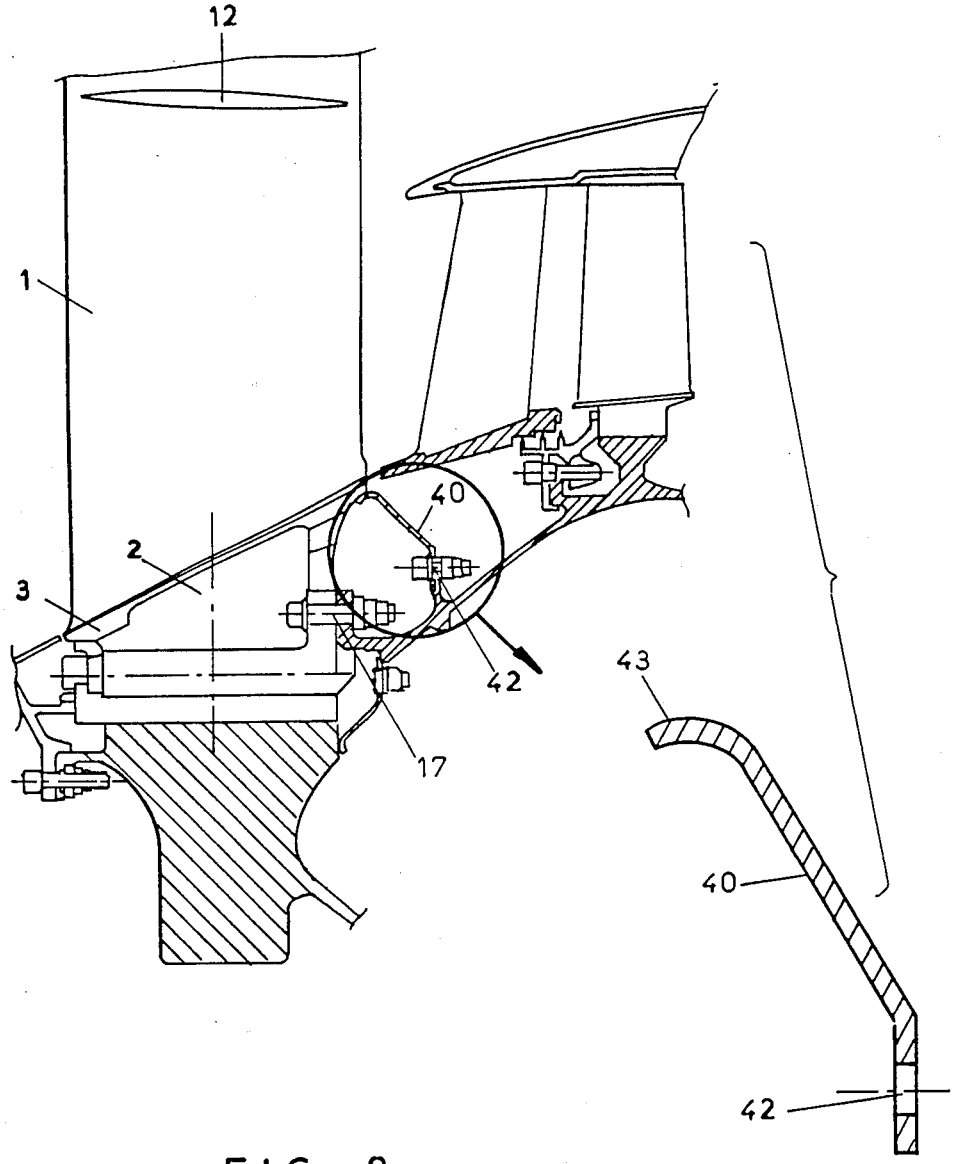
* and FIG. 8 illustrates an embodiment of damping means adapted for incorporation in the embodiment of FIG. 5, together with a partial view in an enlarged scale.

In another modification (FIG. 8) making use of the spacers of FIG. 5, the vibration damping means can take the form of a frusto-conical member 40 secured by screws 42 on the flanged member 16 mounted at 41 on the drum 22. The outer periphery of the face of the frusto-conical member is arcuate shaped as shown at 43 so that it can be applied against a correspondingly rounded member of the lower downstream face of the platform 3 (FIG. 8).

The damping means can also be used in combination with the modification of FIG. 4 with the downstream clearance limiting annular member centred on the outer diameter of the flange 16.

The damping means (discs 14,14' or 40) similarly fulfil a sealing function between the upstream part of the stilt of the blade of the fan and the compressor stage disposed downstream.

Various embodiments of the invention tested at a fan plant during bird ingestion tests have been found to be particularly effective in preventing the overlap of the fins of the fan blades under the shock action, which has thus avoided the destruction of the blade subjected to the shook as well as of downstream stages of the compressor.

The embodiment of FIG. 5 has as a supplementary advantage the capability of being adapted to existing engines by simple machining of the lugs or lobes of the rotor disc periphery and of substantially facilitating repair after accidental ingestion.

Obviously, numerous modifications and variations of the present invention are possible in light of the above teachings. It is therefore to be understood that within the scope of the appended claims, the invention may be practiced otherwise than as specifically described herein.

We claim:

1. A turbomachine rotor disc assembly, comprising:

means defining a rotor disc having a plurality of blade-root accommodating grooves in its outer periphery, each two adjacent grooves defining a lug between said grooves, a corresponding plurality of rotor blades, each blade including an aerofoil portion, a root portion, a platform defining the radially inner boundary of the aerofoil portion, and a stilt portion interconnecting the radially inner face of the platform and the root portion, a free space being defined between each adjacent pair of blades, each blade root being engaged in a corresponding groove of the rotor, and means for limiting the angular clearance of each blade permitting the blade to twist about is major axis, said limiting means comprising wedge means operative between adjacent blades on the stilts thereof and connecting means carrying the wedge means, secured to the rotor disc and capable of transmitting shock loads and distributing resultant forces over an adjacent sector of the rotor, the wedge means being so dimensioned in relation to the dimensions of stilts of adjacent blades that the angular clearance is limited to the permissible angular clearance of each blade during auto-rotation of the rotor wherein the connecting means comprises and annular member including a radial plane portion, the annular member being located downstream of the rotor disc and secured thereto, and wherein the wedge means comprises teeth of rectangular section which are integral with said radial plane portion, and which extend into the free space between stilts of adjacent blades so that the width thereof substantially corresponds to the width of the space in the direction parallel to the axis of rotation of the rotor.

2. An assembly according to claim 1 further comprising a downstream flanged member, the member having an annular flange with regularly distributed bores, the annular member of the connecting means having matching bores to those of the annular flange and the rotor disc having bores matching those of the annular flange and of the annular member, and comprising bolt means passing through respective aligned said bores whereby to secure the rotor, the annular member and the annular flange together.

3. An assembly according to claim 1 further comprising a downstream flanged member including an annular flange portion having regularly distributed bores, the rotor disc having matched bores aligned with those of the annular flange portion, the annular flange portion having an outer peripheral annular recess and the inner periphery of the said radial plane portion of the said annular member having a recess of complementary dimensions to those of the annular flange portion, and comprising bolt means which engage in the aligned bores thereby clamping the portions of the annular flange portion and of the radial plane portion defining the respective recesses.

4. An assembly according to claim 2 wherein the downstream annular member is formed as two semiannular parts.

5. An assembly according to claim 3 wherein the downstream annular member is formed as two semiannular parts.

6. An assembly according to claim 1 wherein the radial plane portion of the annular member is extended radially outwardly by a frusto-conical portion integral at its outer periphery and having a seating of arcuate section engaged against the platforms of each blade whereby to resist vibrations in the blades resultant from shock loading.

7. An assembly according to claim 1, wherein the wedge means and the connecting means comprise spacers of U-shape each mounted in the manner of a saddle on a respective said lug of the rotor disc, bolt means being provided which secure the spacers to the rotor disc, the thickness of each limb of each spacer being such that the angular clearance of the rotor blade is limited to the maximum permissible when the rotor is auto-rotating.

8. An assembly according to claim 7, comprising means for damping vibrations caused in the blades by shock loading, said means including a generally cylindrical block with a longitudinal groove, a cylindrical sheath in which the block is free to slide radially, which sheath is rigid with a said spacer and has a guide tongue engaging in the longitudinal groove of the block, the block being movable into engagement with the radially inner surface of the corresponding blade platform under the action of centrifugal force during operation of the assembly thereby to counteract any tendency of the corresponding blade to vibrate.

* * * * *

UNITED STATES PATENT AND TRADEMARK OFFICE

CERTIFICATE OF CORRECTION

PATENT NO. : 4,723,889

DATED : FEBRUARY 9, 1988

INVENTOR(S) : DENIS C. CHARRERON ET AL

It is certified that error appears in the above-identified patent and that said Letters Patent is hereby corrected as shown below:

In column 1, line 13, change "mannner" to --manner--;

line 30, change "other of a" to -- other a--;

line 57, change "stopage" to --stoppage--;

In column 2, line 18, change "fulfil" to --fulfill--;

line 27, change "object" to --objects--;

line 56, change "down time" to --downtime--;

In column 5, line 30, change "FIG. 1." to --FIG. 1--;

line 38, change "centred" to --centered--;

line 45, after "suffers" insert --on--;

In column 7, line 5, change "centred" to --centered--;

line 7, change "fulfil" to --fulfill--;

UNITED STATES PATENT AND TRADEMARK OFFICE

CERTIFICATE OF CORRECTION

PATENT NO. : 4,723,889

DATED : FEBRUARY 9, 1988

INVENTOR(S) : DENIS C. CHARRERON ET AL

It is certified that error appears in the above-identified patent and that said Letters Patent is hereby corrected as shown below:

Column 7, line 16, change "shook" to --shock--;

line 48, change "is" to --its--.

Signed and Sealed this

Eighteenth Day of October, 1988

*Attest:*

DONALD J. QUIGG

*Attesting Officer*

*Commissioner of Patents and Trademarks*